US007854354B2

(12) United States Patent
Laible

(10) Patent No.: US 7,854,354 B2
(45) Date of Patent: Dec. 21, 2010

(54) DOCKING STATION FOR A LIQUID CONTAINER INCLUDING A LIQUID DISPENSER

(76) Inventor: Rodney Laible, 7417 N. 101st St., Omaha, NE (US) 68122

( * ) Notice: Subject to any disclaimer, the term of this patent is extended or adjusted under 35 U.S.C. 154(b) by 151 days.

(21) Appl. No.: 12/380,720

(22) Filed: Mar. 3, 2009

(65) Prior Publication Data

US 2009/0272766 A1 Nov. 5, 2009

Related U.S. Application Data

(63) Continuation-in-part of application No. 11/451,215, filed on Jun. 12, 2006, now Pat. No. 7,631,783.

(51) Int. Cl.
*B65D 88/54* (2006.01)

(52) U.S. Cl. ..... 222/325; 222/153.04; 222/182; 222/402.14; 222/464.1; 141/346; 137/614.06; 251/149.9

(58) Field of Classification Search ..... 141/311 R, 141/346, 348; 137/614, 614.06; 251/149.1, 251/149.9; 222/146.1, 153.01, 153.04, 153.11, 222/181.3, 182–183, 402.14, 464.1, 325
See application file for complete search history.

(56) References Cited

U.S. PATENT DOCUMENTS 5,027,986 A * 7/1991 Heinzel et al. ..... 222/402.24
5,110,231 A * 5/1992 Monteith et al. ..... 401/190
5,988,456 A * 11/1999 Laible ..... 222/464.1
6,142,345 A 11/2000 Laible
6,318,600 B1 * 11/2001 Winnett et al. ..... 222/173
6,868,989 B2 * 3/2005 Fahy et al. ..... 222/174
6,923,345 B1 8/2005 Laible
6,945,432 B2 * 9/2005 Laible ..... 222/185.1
6,945,433 B2 9/2005 Laible
6,968,983 B2 11/2005 Laible
6,981,533 B2 * 1/2006 Zorzo ..... 141/351
6,986,443 B2 1/2006 Laible

* cited by examiner

*Primary Examiner*—Kevin P Shaver
*Assistant Examiner*—Andrew Bainbridge
(74) *Attorney, Agent, or Firm*—Dennis L. Thomte; Thomte Patent Law Office LLC

(57) ABSTRACT

A docking station for use with a liquid container which supports the container in a convenient fixed location. The docking station is designed to accept a liquid container having a predetermined height and diameter. The docking station includes a cam operated actuator which is movable between an upper "open" position to a lower "closed" position. When the actuator is moved to its lower closed position, the actuator opens a valve in the liquid container to permit liquid to be drawn from the container. When the actuator is in its upper position, the valve in the container is closed. A manually controlled dispenser is mounted on the upper end of the docking station which is in communication with a source of water under pressure and the liquid being drawn from the container so as to mix the same and to dispense the same.

4 Claims, 11 Drawing Sheets

DOCKING STATION FOR A LIQUID CONTAINER INCLUDING A LIQUID DISPENSER

CROSS REFERENCE TO RELATED APPLICATION

This is a continuation-in-part application of U.S. patent application Ser. No. 11/451,215, now issued as U.S. Pat. No. 7,631,783 filed Jun. 12, 2006 entitled DOCKING STATION FOR A LIQUID CONTAINER.

BACKGROUND OF THE INVENTION

1. Field of the Invention

This invention relates to a docking station for a liquid container and more particularly to a docking station for a liquid container which is adapted to receive a liquid container such as a bottle or the like containing liquids with the docking station being adapted to accept only bottles of a particular height and diameter to ensure that the proper liquid will be dispensed to a mixing machine, spray nozzle, etc. Even more particularly, this invention relates to a hand-operated liquid dispenser which is mounted on the upper end of the docking station to enable a person to dispense liquid from the liquid container and mix the same with water and dispense the mixture into a bucket, spray bottle, etc.

2. Description of the Related Art

Corrosive liquid chemicals are typically contained in a container such as a bottle or the like and are frequently dispensed therefrom to a mixing machine, spray nozzle, etc. Normally, a cap is placed on the bottle with a dip tube extending therefrom downwardly into the interior of the bottle for drawing the liquid upwardly thereinto. Normally, a dispensing tube extends from the cap to a mixing machine or to some other piece of equipment which creates suction in the dispensing tube to draw the liquid from the interior of the bottle.

Applicant has previously provided several liquid dispensing systems wherein a throat plug assembly including a valve is positioned in the throat of the bottle with the valve normally being closed but which is opened upon the attachment of a dispensing cap mounted on the upper end of the bottle. Normally, a dispensing tube extends from the dispensing cap to the spray nozzle or to an on-off valve to enable the contents from the bottle to be introduced into a spray bottle or the like. Heretofore, there has not been a convenient means for supporting the bottle during the use thereof. Further, in some cases, the wrong bottle was connected to the spray nozzle or on-off valve which resulted in the wrong chemicals being supplied thereto. Although the docking station of the co-pending application works extremely well, it requires that the liquid chemical being dispensed from the docking station must be mixed with water in a separate step to obtain the proper chemical/water mixture. When the liquid chemical from the container is dispensed into a spray bottle for example, the proper amount of water must be placed in the spray bottle before the liquid chemical is dispensed thereunto or the proper amount of water must be placed in the spray bottle after the liquid chemical is dispensed thereunto.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter A docking station is provided for a liquid container which normally has corrosive liquids therein which may be used for cleaning purposes or the like. The liquid container has upper and lower ends and has a hollow throat extending upwardly therefrom which has interior and exterior surfaces. A throat plug assembly, having upper and lower ends, is positioned in the throat of the container to selectively close the hollow throat. The throat plug assembly includes a movable valve, having inlet and discharge sides, which is movable between an upper closed position to a lower open position. The valve, when in its lower open position, permits the flow of liquid therethrough. The valve, when its upper closed position, prevents the flow of liquid therethrough. A dip tube extends downwardly from the inlet side of the valve into the liquid container. The liquid container is placed in the docking station of this invention with the docking station adapted to receive a bottle of a particular height and diameter to ensure that only the proper bottle is received thereby. The docking station has a manually movable actuator mounted at the upper end thereof which is movable between an upper position to a lower position. The actuator has a lower liquid inlet end and an upper liquid discharge end. The upper liquid discharge end has a discharge tube extending therefrom. The lower liquid inlet end of the actuator is in physical engagement with the discharge side of the valve and is in fluid communication therewith, when the actuator is in its lower open position to open the valve so that liquid in the container may pass upwardly through the dip tube, through the valve, through the actuator and outwardly through the discharge tube. The valve is closed when the actuator is in its upper position. The actuator is moved between its upper and lower positions by means of a cam assembly.

The instant invention comprises a manually operable dispenser which is rotatably positioned on the upper end of the docking station. The manually operable dispenser includes a body member including a generally horizontally disposed first body portion having first and second sides, a water inlet end and a discharge end. The body member also includes a generally vertically disposed second body portion extending downwardly from the first body portion. The lower end of the second body portion is selectively rotatably secure, about a vertical axis, to the upper end of the docking station. A first passageway extends from the inlet end of the body member to the discharge end of the body member. The first passageway has an inlet end adopted to be in communication with a source of water under pressure. A selectively first valve is imposed in the first passageway for controlling the flow of water therethrough. The body member has a second passageway formed therein having a lower end which is in communication with the discharge tube of the docking station and having an upper end which is in communication with the first passageway downstream of the first valve whereby passage of water through the first passageway downstream of the first valve will draw liquid from the liquid container upwardly through the second passageway into the first passageway for mixing with the water passing therethrough. A second valve is imposed in the second passageway for controlling the flow of liquid from the container therethrough. A dispensing tube is connected to the discharge end of the first passageway for dispensing the liquid chemical-water mixture into a spray bottle, bucket, etc.

It is therefore a principal object of the invention to provide a docking station for a liquid container with the docking station having a manually operable dispenser mounted on the upper end thereof.

A further object of the invention is to provide a docking station for a liquid container which is adapted to receive a liquid container of a predetermined height and diameter.

A further object of the invention is to provide a docking station for a liquid container which is convenient and safe to use and which conveniently dispenses a liquid chemical-water mixture into a container such as a spray bottle, bucket, etc.

These and other objects will be obvious to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
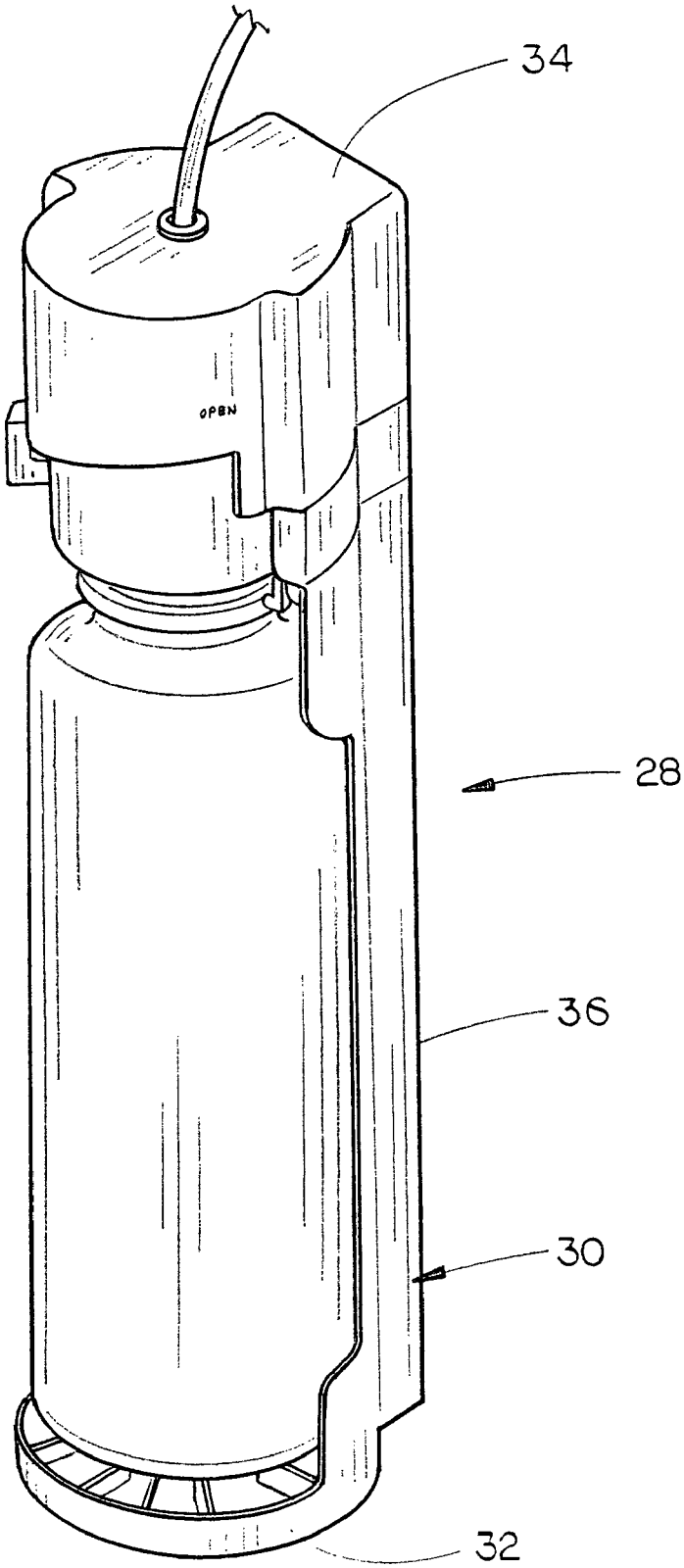
FIG. 1 is perspective view of the docking station of the invention of the co-pending application having a bottle or liquid container positioned therein.
Figure 2:
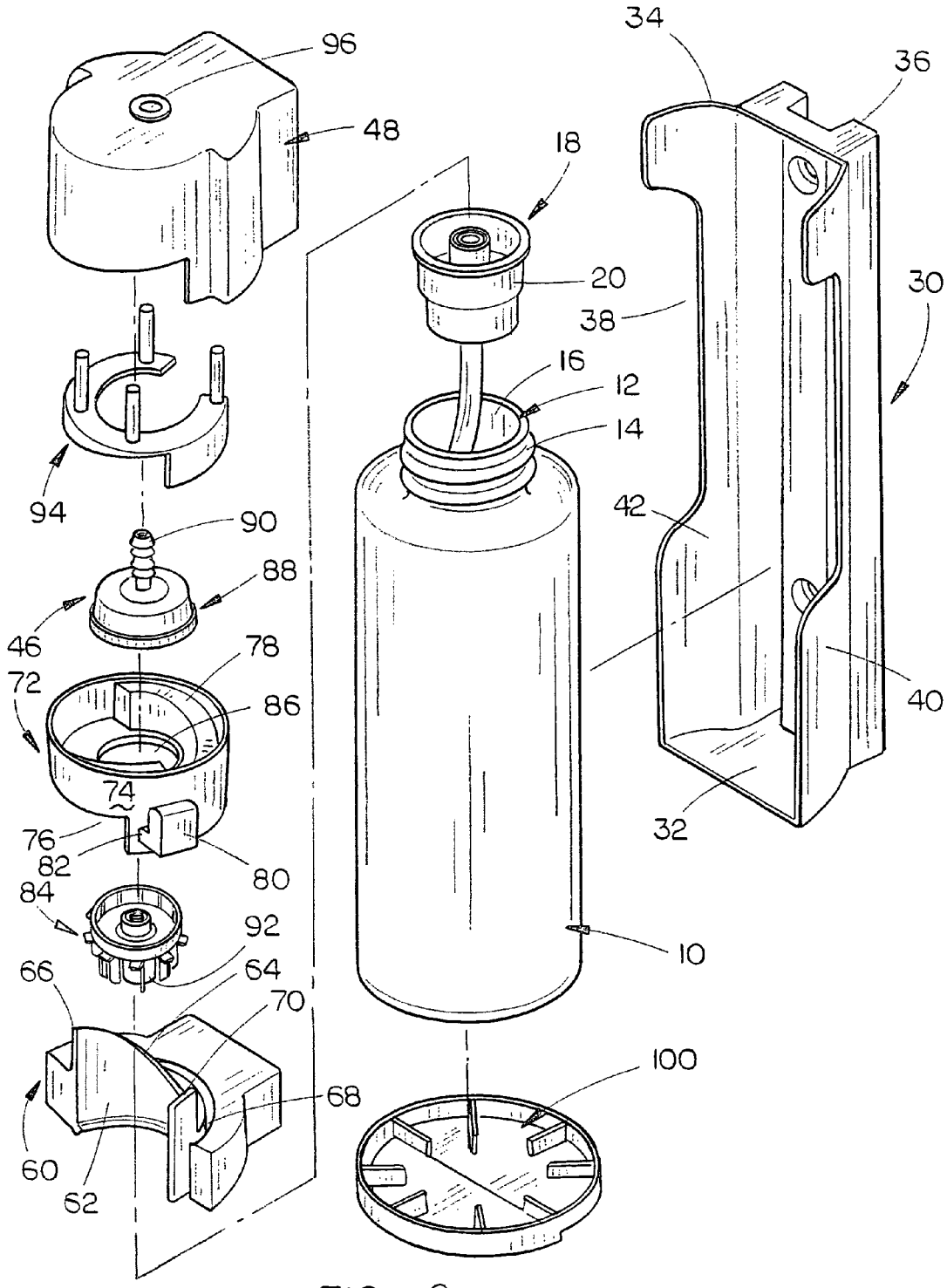
FIG. 2 is an exploded perspective view of the docking station and liquid container of the co-pending application.
Figure 3:
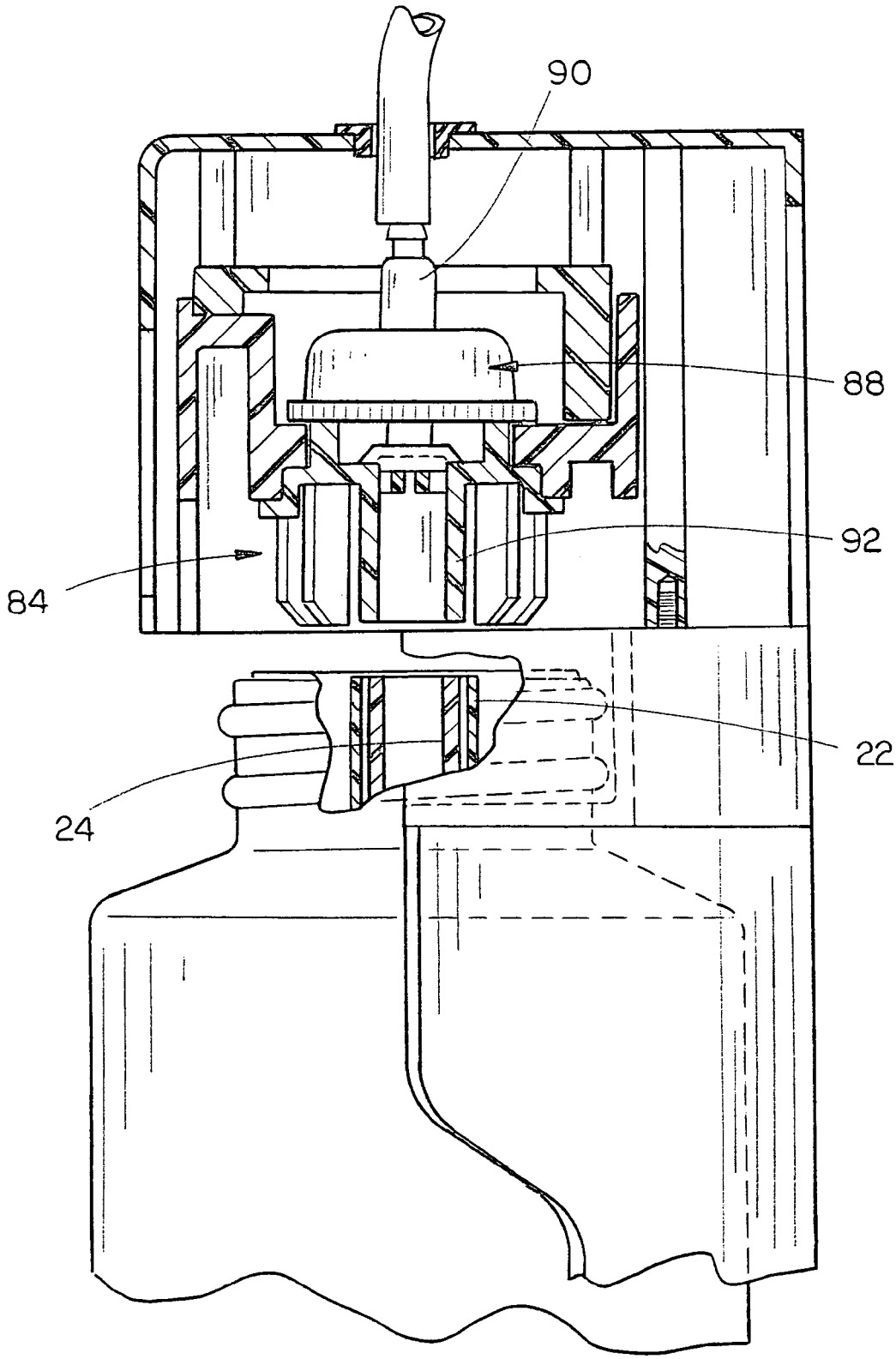
FIG. 3 is a partial vertical sectional view of the upper end of the docking station and the liquid container of the co-pending application.
Figure 4:
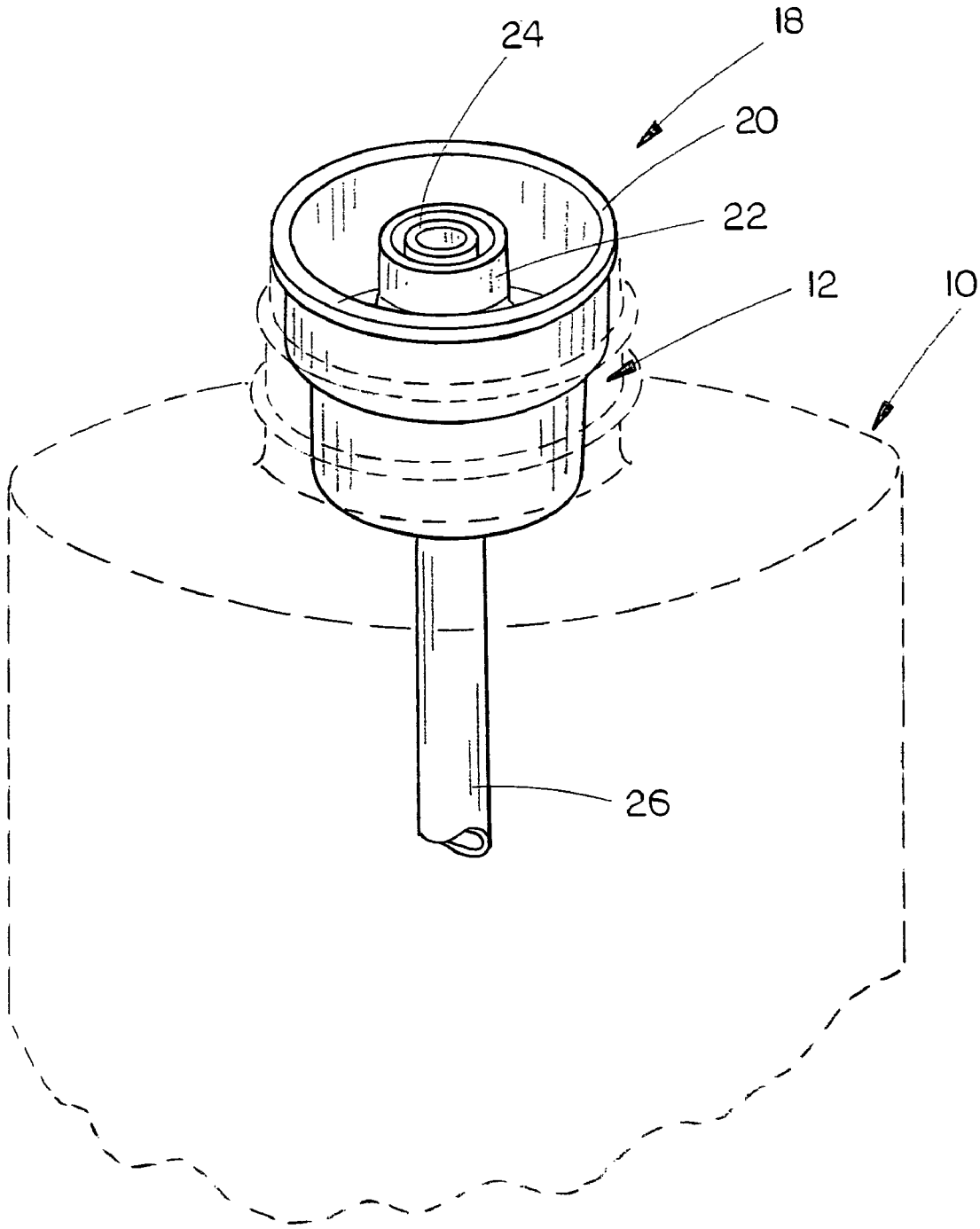
FIG. 4 is a perspective view of the throat plug assembly positioned in the upper end of the liquid container of the co-pending application.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The structure of the co-pending application is shown in FIGS. 1-6. In the drawings of the co-pending application, the numeral 10 refers to a liquid container having a hollow throat 12 extending upwardly therefrom which has an externally threaded surface 14 and an interior surface 16. A throat plug assembly 18 is press-fitted into throat 12 and is closely similar to the throat plug assembly disclosed in U.S. Pat. No. 5,988,456 which issued Nov. 23, 1999. Assembly 18 includes a tapered cup-shaped plug 20 which is inserted into the throat 12. Assembly 18 also includes a valve stem 22 having a normally closed valve 24 vertically movably mounted therein. Valve 24 is normally maintained in its upper closed position of FIG. 3 by a spring (not shown). When valve 24 is moved to its lower open position, liquid may pass upwardly therethrough in the manner disclosed in U.S. Pat. No. 5,988,456. Dip tube 26 extends downwardly from plug 20 into container 10 to supply liquid to the inlet side of valve 24 as in the '456 patent.

The numeral 28 refers to the docking station of this invention which is adapted to receive a liquid container having a predetermined height and outside diameter. Docking station 28 includes a bracket or support 30 having a lower end 32, upper end 34, back side 36 and an open front side 38 defined by side walls 40 and 42. Bracket 30 may be secured to a wall or the like by extending screws or the like through the openings 44 formed in back side 36.

An actuator assembly 46 is positioned at the upper end of support 30 and is partially enclosed in a hollow hood 48. The front wall 50 of hood 48 is provided with a cam surface 52 including a horizontally disposed portion 54 at the upper end thereof, an inclined portion 56 extending downwardly from portion 54, and a horizontally disposed portion 58. The word "OPEN" is provided on front wall 50 of hood 48 as is the word "CLOSED".

Actuator assembly 46 includes a cam block 60 positioned on top of upper end 34 of support 30. Cam block 60 is provided with a semi-circular wall member 62 having a cam surface 64 at its upper end which has an upper end 66 and a lower end 68. An upstanding stop 70 is positioned at the lower end 68 of cam surface 64. A rotatable actuator support 72 is mounted within hood 48, as seen in the drawings. Actuator support 72 includes an outer cylindrical wall 74 having a cut-out portion 76 formed therein at the lower end thereof which extends approximately half way around the support 72. The interior of support 72 has a cam surface 78 formed therein which rides upon the cam surface 64. Actuator lever 80 extends outwardly from actuator support 72 and includes a horizontal portion 82 which engages the underside of cam surface 52.

Actuator 84 has its upper end rotatably received by the central opening 86 in actuator support 72 and is maintained therein by a hollow connector 88 having a nipple 90 extending upwardly therefrom. Actuator 84 includes a hollow tubular member 92 positioned therein, the lower end of which is adapted to engage the upper end of valve 24, as will be described hereinafter. The upper end of tubular member 92 is in fluid communication with the interior of connector 88 and nipple 90. Support 94 is secured to the upper end of hood 48 at the inside thereof to aid in attaching hood 48 to actuator support 72 which is attached to cam block 60 which is secured to bracket 30 by screws or the like. The upper end of hood 48 is provided with an opening 96 through which extends a discharge hose or tube 98 which is mounted on nipple 90.

Preferably, a disc-shaped support 100 is positioned on the interior lower end 32 of bracket 30 to support the container 10 thereon.

The distance between the upper end of support 100 and the lower end of the actuator 84 is predetermined so that only a bottle or container having a predetermined height may be positioned therebetween to ensure that a bottle or container having the proper liquid therein may be utilized in the docking station. Further, the distance between the edges of side walls 40 and 42 is such that a bottle or container having a predetermined diameter will be received therebetween. Additionally, it is preferred that a conventional cabinet lock (not shown) be positioned in hood 48 so that the cam mechanism may be selectively locked in its upper open position.

The normal method of using the docking station 28 will now be described. The station 28 is secured to a vertical supporting surface such as a wall by screws, as previously described. Actuator lever 80 is moved to its open position (FIG. 5) so that horizontal portion 82 engages the portion 54 of cam surface 52 so that lever 80 yieldably remains in the open position. With the lever 80 in its open position, the actuator 84 is in its upper position (FIG. 5).

A bottle 10 of predetermined height and diameter is placed in the docking station with the valve 24 being in its closed position. When it is desired to dispense liquid from the bottle 10, the lever 80 is moved from its "open" position of FIG. 5 to its "closed" position of FIG. 6. As lever 80 is moved as described, the interaction of cam surfaces 64 and 78 causes tubular member 92 of actuator 84 to be moved downwardly into engagement with valve 24 to move valve 24 downwardly to its open position. The liquid in the bottle 10 may then be drawn upwardly through the dip tube 26, through valve 24, through tubular member 92, through nipple 90, and outwardly through tube 98 to a mixing machine, spray nozzle, on-off valve or the like.

Figure 6:
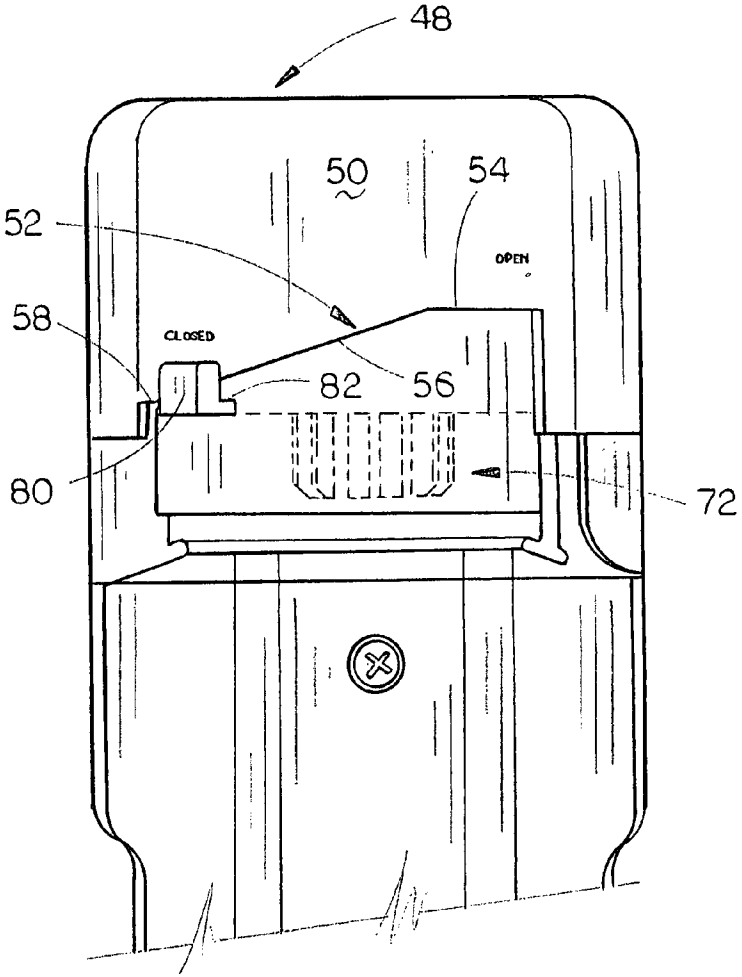
FIG. 6 is a view similar to FIG. 5 except that the valve actuator of the co-pending application has been moved downwardly from its upper open position to its lower closed position.
Figure 5:
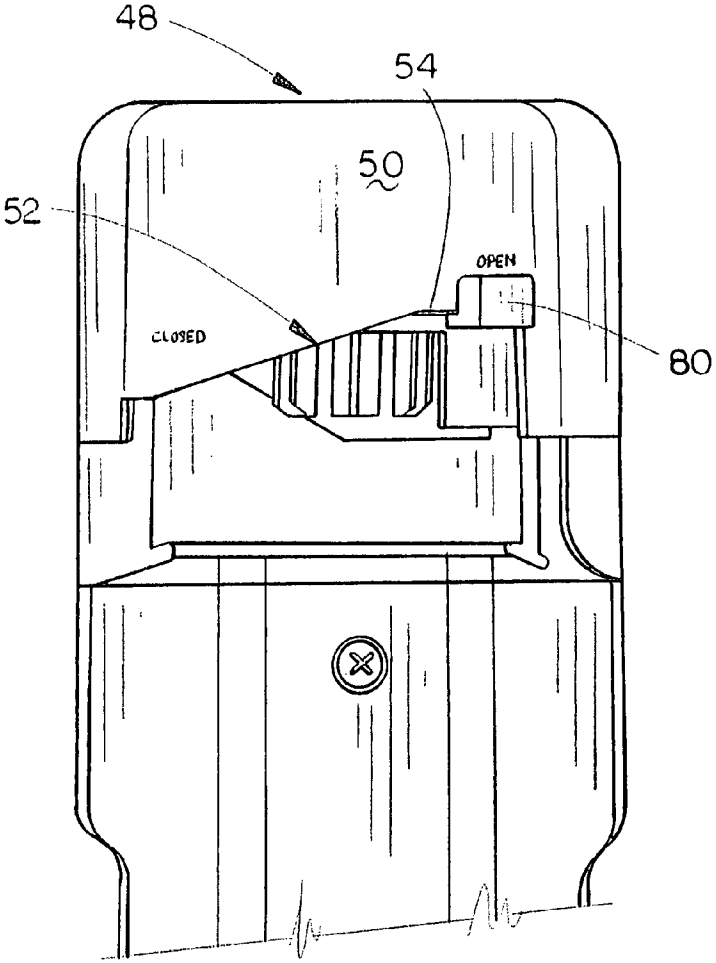
FIG. 5 is a partial side view of the upper end of the docking station of the co-pending application illustrating the valve actuator thereof in its upper open position.
Figure 7:
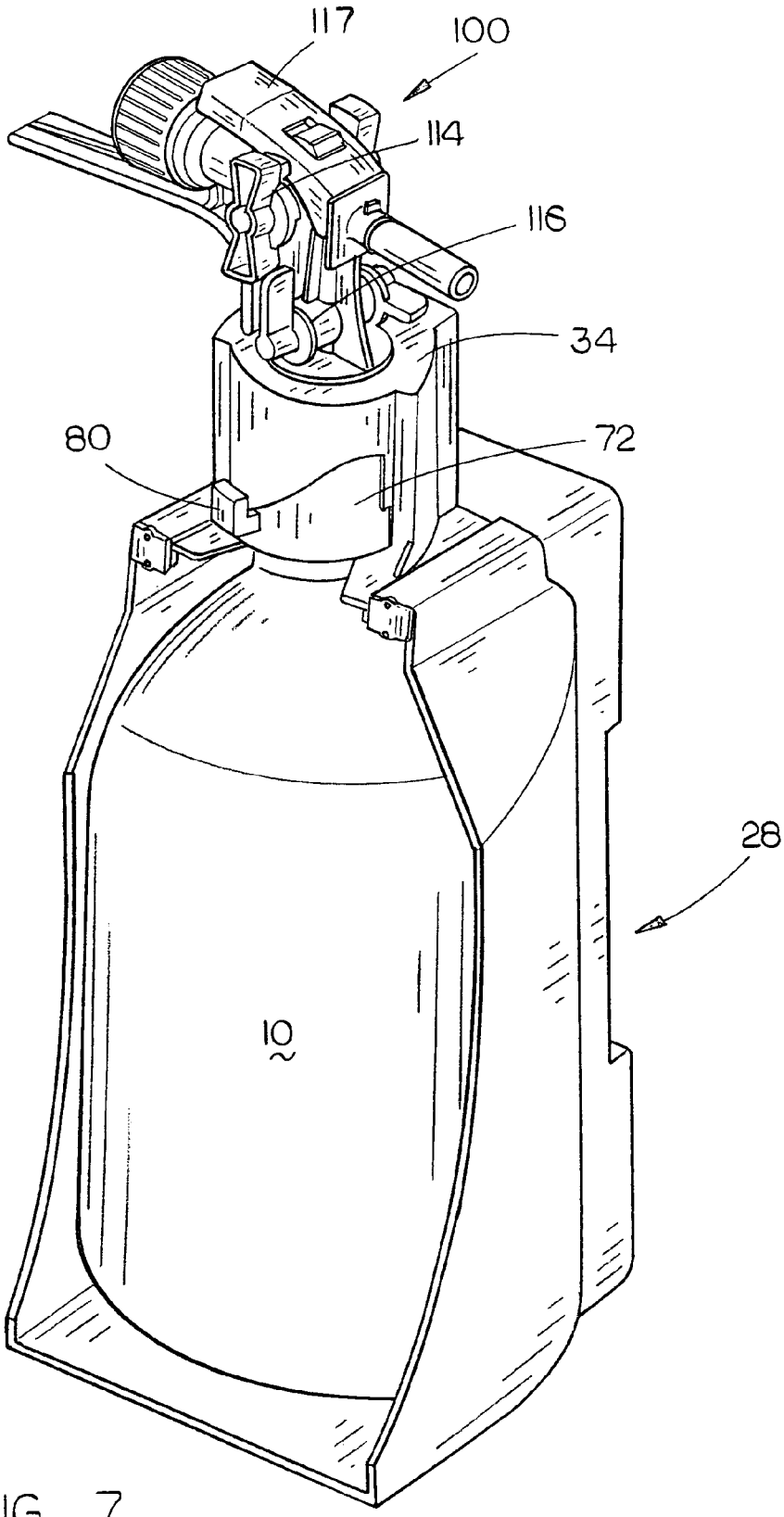
FIG. 7 is a perspective view of the docking station and liquid container of the co-pending application having a dispenser mounted on the upper end thereof.
Figure 8:
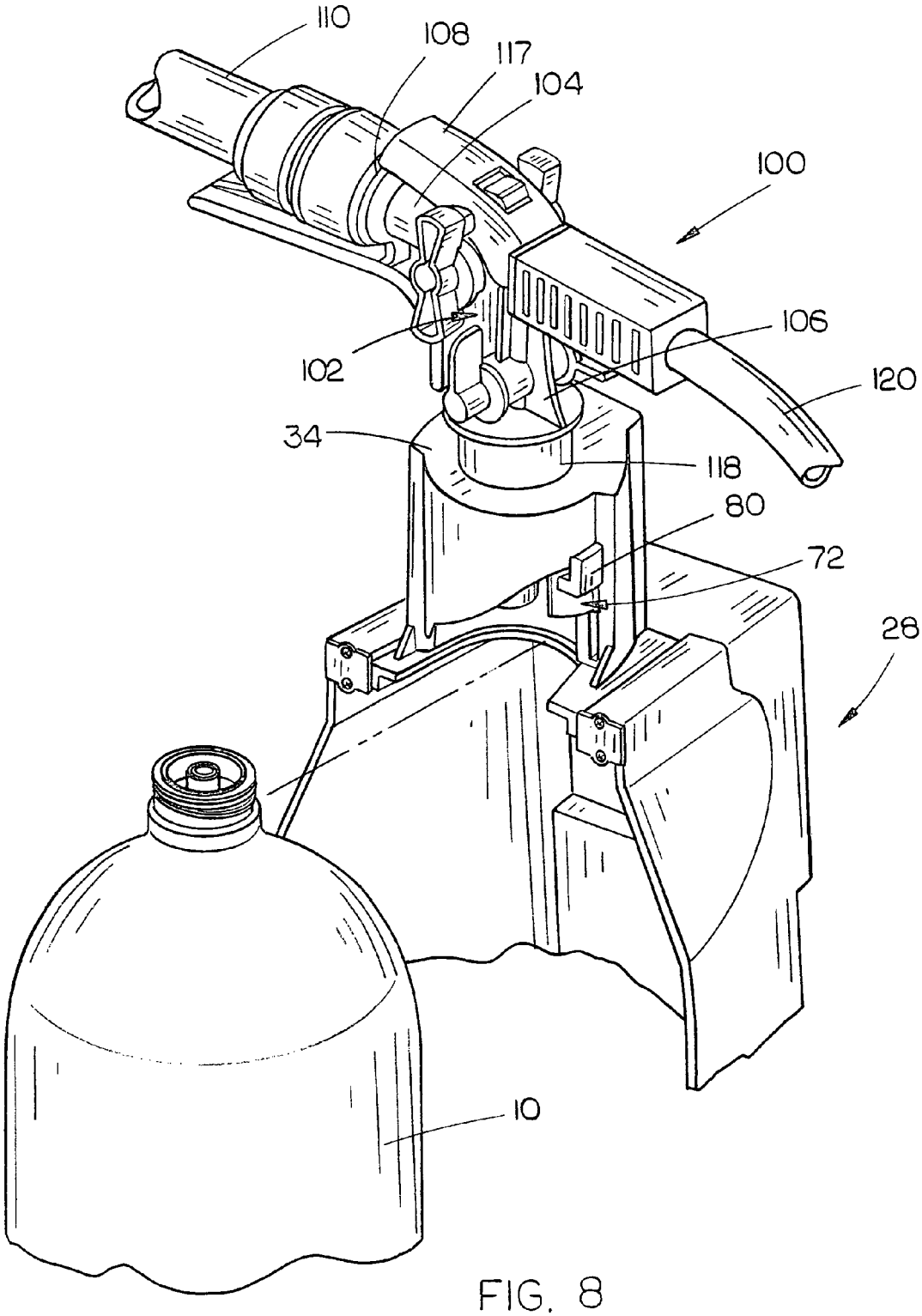
FIG. 8 illustrates the liquid container being removed from the docking station with the valve actuator of the docking station being in its "off" position.
Figure 9:
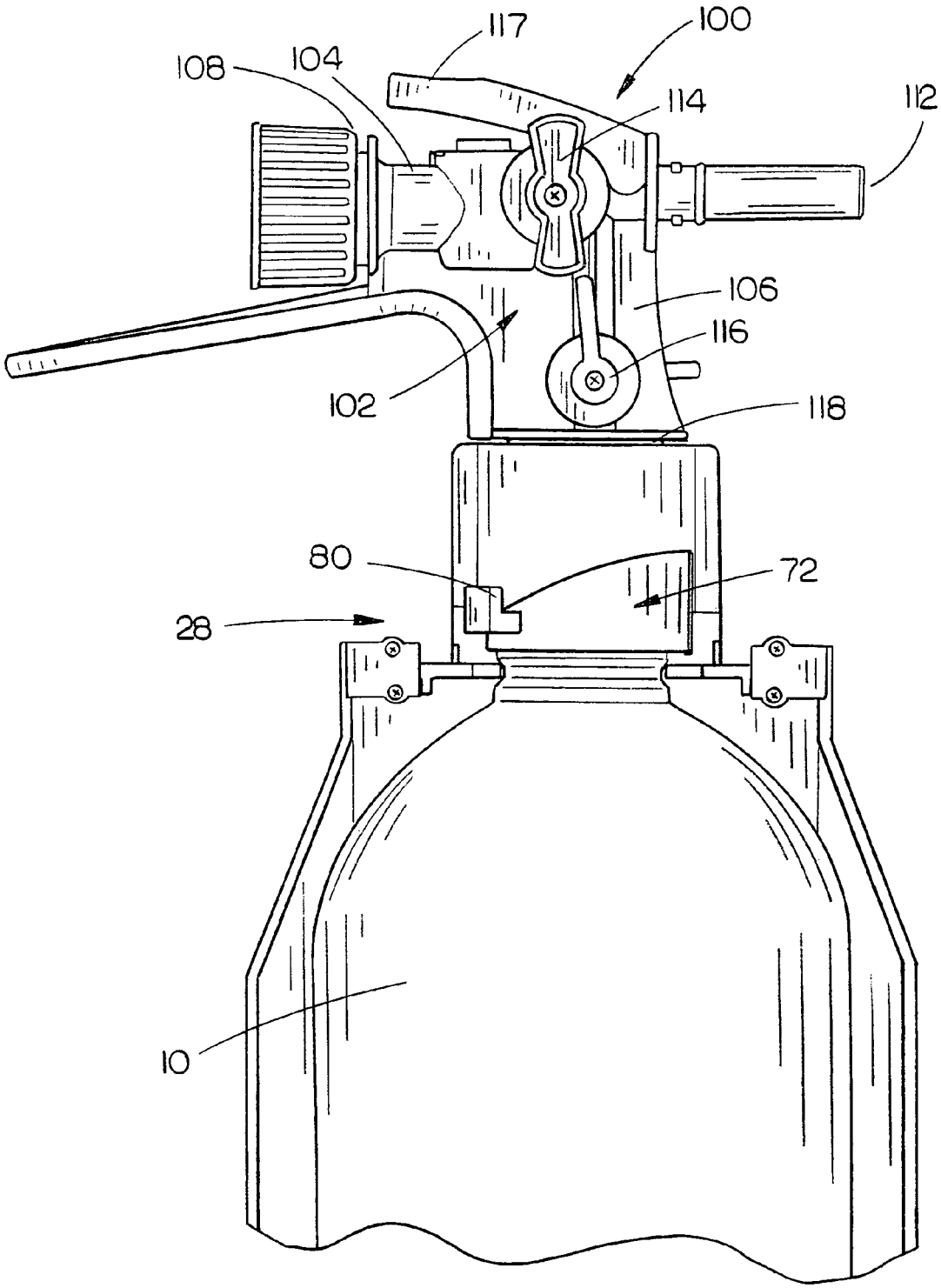
FIG. 9 is a partial front view which illustrates the liquid container in place in the docking station with the valve actuator of the docking station being in its "on" position so that the throat plug assembly in the upper end of the liquid container is in its "open" or dispensing position.
Figure 10:
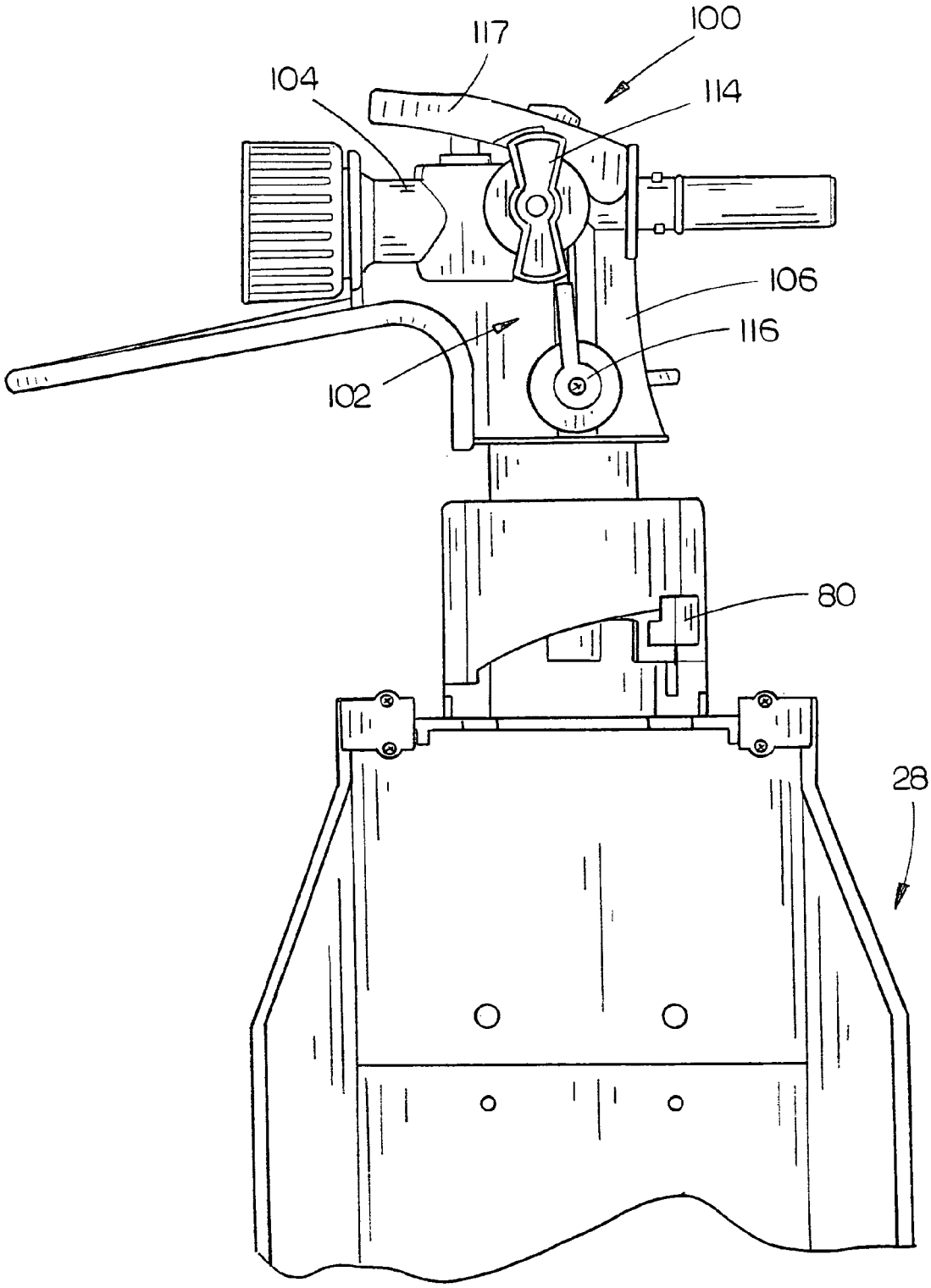
FIG. 10 is a front view illustrating the docking station with the liquid container removed therefrom and with the valve actuator thereof in its "off" position.
Figure 11:
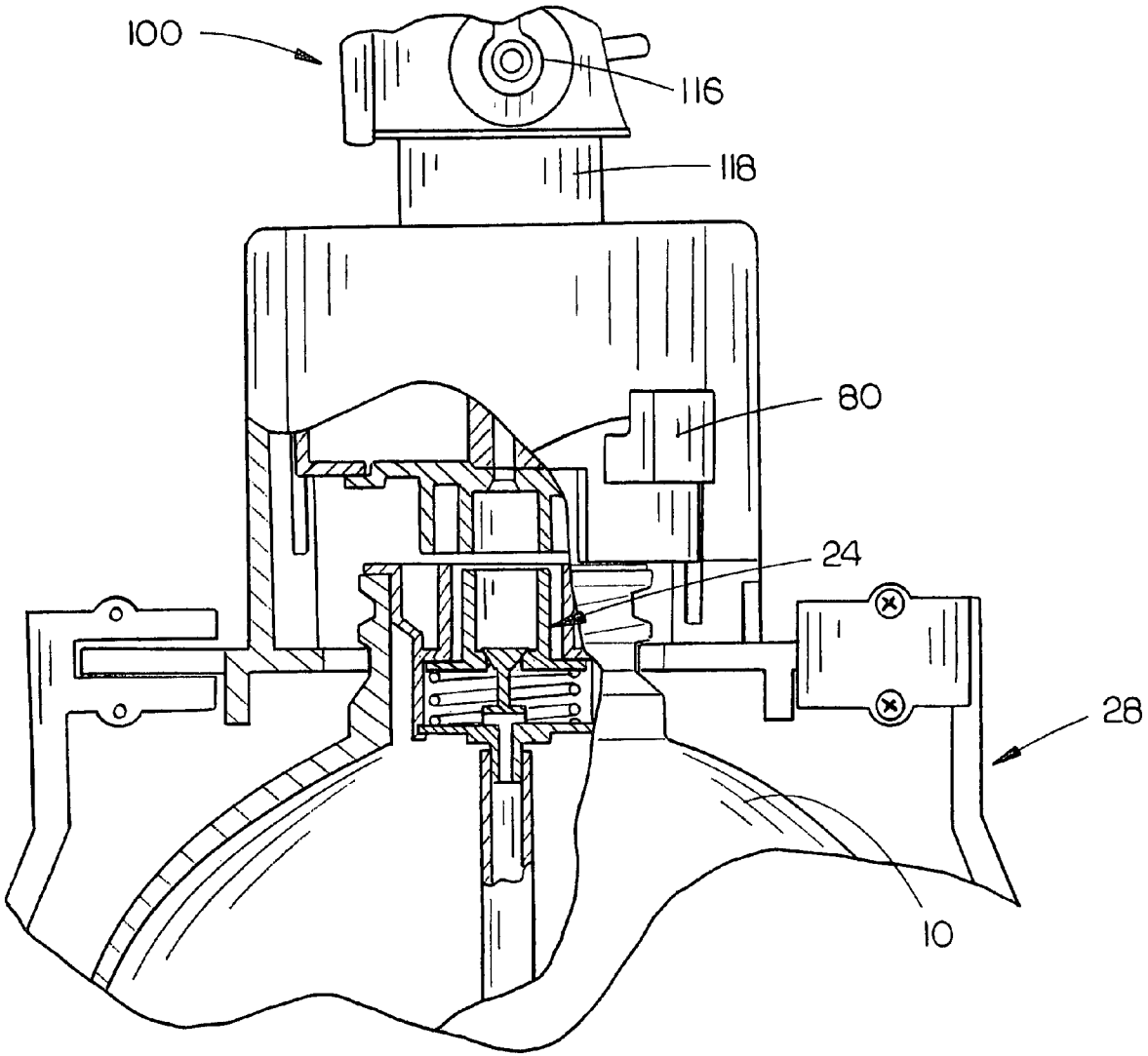
FIG. 11 is a partial sectional view illustrating the valve actuator in its "off" position.
Figure 12:
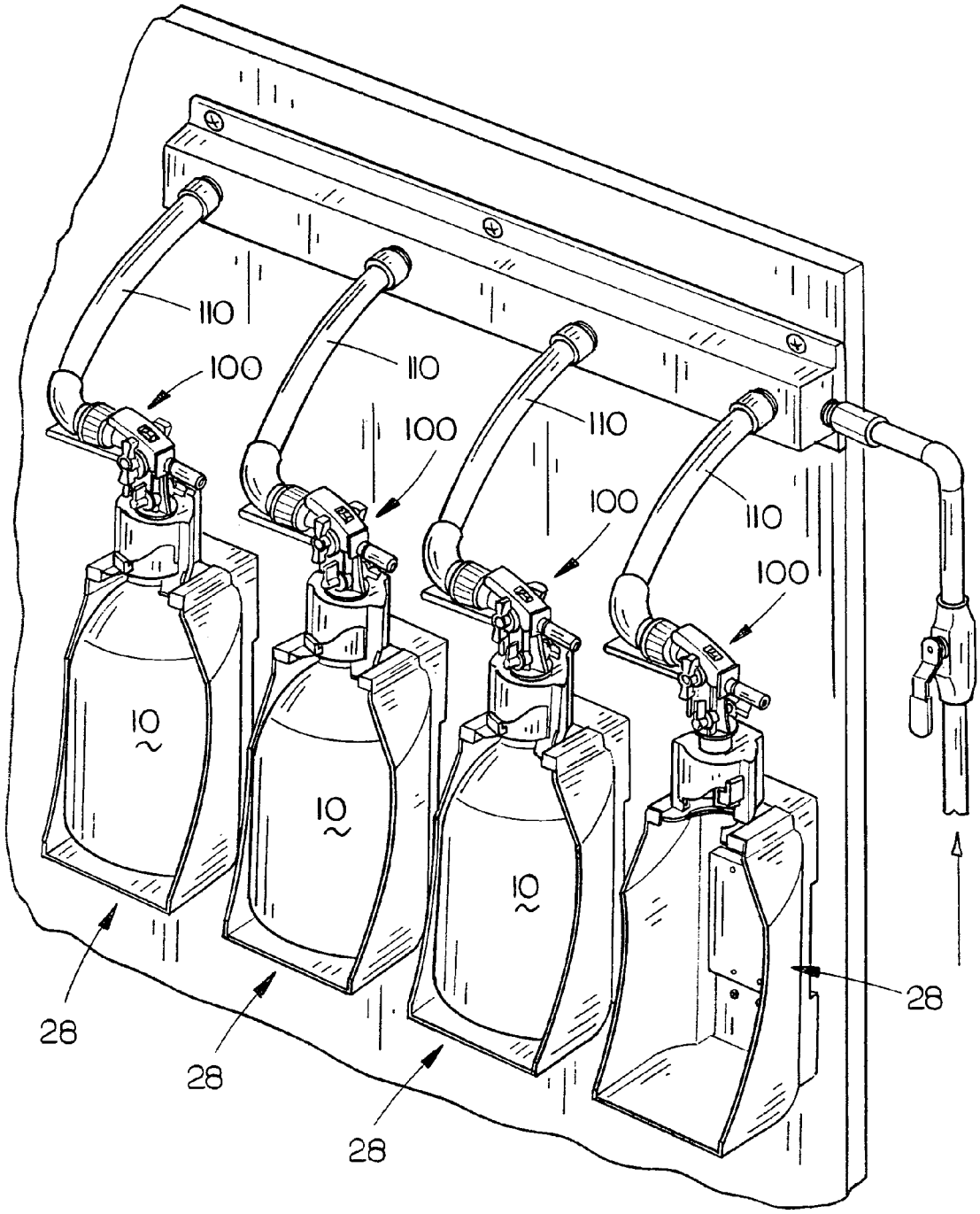
FIG. 12 is a perspective view illustrating a bank of the docking stations of this invention.

When it is desired to close the valve 24, the lever 80 is moved from its "closed" position of FIG. 6 to its "open" position of FIG. 5 thereby causing tubular member 92 to move upwardly so that valve 24 closes. Thus, it can be seen that a unique docking station has been provided to provide a convenient means for supporting a liquid container therein.

The docking station of this invention is illustrated in FIGS. 7-12. The docking station 28 of FIGS. 7-12 is identical to the docking station 28 of FIGS. 1-6 except that a dispenser 100 is rotatably mounted on the upper end of the docking station 28. Dispenser 100 is substantially identical to the dispenser disclosed in the co-pending application of applicant which was filed on Feb. 20, 2009 entitled HAND-HELD DISPENSER, the disclosure of which is incorporated herein by reference thereto.

Dispenser 100 includes a body member 102 including a horizontally disposed first body portion 104 and a vertically disposed body portion 106. The water inlet end 108 of dispenser 100 is operatively connected to a water hose or conduit 110 which is in communication with a source of water under pressure. As in the application filed on Feb. 20, 2009, the body member 102 has a first passageway extending between its inlet end 108 and its discharge end. A selectively rotatable valve 114 is mounted in body 102 for controlling the flow rate of water passing through the first passageway. Body 102 also has a second passageway formed therein which extends downwardly from the first passageway on the downstream side of valve 114, the lower end of which is in communication with the discharge side of the docking station 28. Valve 116 is rotatably mounted in body portion 106 for controlling the flow of liquid from the discharge side of the docking station. Dispenser 100 also includes an "on-off" lever 107 pivotally mounted thereon for opening and closing the first passageway.

The lower end of body portion 106 has a cylindrical hollow mount 118 extending downwardly therefrom which is rotatably received by the upper end of the docking station to permit the dispenser 100 to be rotated, about a vertical axis, with respect to docking station 28.

The docking station 28 is adapted to have the liquid container 10 mounted therein. Container 10 has a throat plug assembly 18 mounted in the throat of the container. Throat plug assembly includes a normally closed valve 24 therein.

Thus, when the lever 80 is in its upper "open" position, the valve 24 is closed. When it is desired to dispense a mixture of the liquid chemical with the water passing through the dispenser, lever 80 is moved downwardly from its "open" position to its "closed" position so that valve 24 is opened.

Valve 116 is adjusted to control the rate of liquid chemical through the passageway in body portion 106. Valve 114 is adjusted to control the rate of water flow passing through the first passageway. A discharge nozzle assembly 120 will be mounted on the discharge end of dispenser 100, if not previously positioned thereon. The operator will then place a spray bottle, bucket, etc. at the discharge end of the assembly 120. The operator will then depress the lever 107 to cause water to flow through the dispenser. The juncture of the first and second passageway form a venturi action as water passes thereby so that liquid is drawn from the container 10 into the water so that the liquid chemical is mixed in the proper ratio with the water. The mixture is then discharged from the dispenser into the spray bottle, bucket, etc.

Thus, it can be seen that a novel docking system/dispenser has been provided which enables a person to dispense a liquid chemical/water mixture into a suitable receptacle.

Thus, it can be seen that the invention accomplishes at least all of its stated objectives.

The invention claimed is:

1. In combination:

a liquid container having upper and lower ends;

said container having a hollow throat extending upwardly therefrom which has interior and exterior surfaces;

a throat plug assembly, having upper and lower ends, positioned in said throat of said container to selectively close said hollow throat;

said throat plug assembly including a movable valve, having inlet and discharge sides, which is movable between an upper closed position to a lower open position;

said valve, when in its said lower open position, permitting flow of liquid therethrough;

said valve, when in its said upper closed position, preventing the flow of liquid therethrough;

a dip tube extending downwardly from said inlet side of said valve into said liquid container;

and a docking station, having upper and lower ends, adapted to have said liquid container selectively removably positioned therein;

said docking station having a manually movable actuator mounted at said upper end thereof which is movable between an upper position to a lower position;

said actuator having a lower liquid inlet end and an upper liquid discharge end;

said upper liquid discharge end having a discharge tube operatively connected thereto;

said lower liquid inlet end of said actuator being in physical engagement with and in fluid communication with said discharge side of said valve, when said actuator is in its said lower open position, to open said valve, so that liquid in said container may pass upwardly through said actuator and outwardly through said discharge tube;

said valve being closed when said actuator is in its said upper position;

and a manually operable dispenser mounted on the upper end of said docking station which is in communication with said discharge tube and a source of water under pressure;

said dispenser including means for controlling the rate of water flow therethrough and for controlling the rate of flow from the liquid container into the water passing through said dispenser.

2. The combination of claim 1 wherein a manually operable cam mechanism causes said actuator to move between its said upper and lower positions.

3. In combination with a liquid container having upper and lower ends, a hollow throat extending upwardly therefrom which has a throat plug assembly positioned therein to selectively close the hollow throat, the throat plug assembly including a movable valve which is movable between an upper closed position to a lower open position, and a dip tube extending downwardly from the valve into the container, comprising:

a docking station having upper and lower ends, adapted to have said liquid container selectively removably positioned therein;

said docking station having a manually movable actuator mounted at said upper end thereof which is movable between an upper position to a lower position;

said actuator having a lower liquid inlet end and an upper liquid discharge end;

said upper liquid discharge end having a discharge tube operatively connected thereto;

said lower liquid inlet end of said actuator being in physical engagement with and in fluid communication with said discharge side of said valve, when said actuator is in its said lower open position, to open said valve, so that liquid in said container may pass upwardly through said actuator and outwardly through said discharge tube;

said valve being closed when said actuator is in its said upper position;

and a manually operable dispenser mounted on the upper end of said docking station which is in communication with said discharge tube and a source of water under pressure;

said dispenser including means for controlling the rate of water flow therethrough and for controlling the rate of flow from the liquid container into the water passing through said dispenser.

4. The combination of claim 3 wherein a manually operable cam mechanism causes said actuator to move between its said upper and lower positions.

* * * * *